United States Patent [19]

Gladow

[11] Patent Number: 5,060,569

[45] Date of Patent: Oct. 29, 1991

[54] APPARATUS FOR CHANGEOVER OF CYLINDERS IN WEB FED PRINTING PRESS

[75] Inventor: Dean E. Gladow, Emporia, Kans.

[73] Assignee: Didde Web Press Corporation, Emporia, Kans.

[21] Appl. No.: 370,759

[22] Filed: Jun. 22, 1989

[51] Int. Cl.[5] ..... B41F 5/00

[52] U.S. Cl. ..... 101/216; 101/DIG. 35; 101/181

[58] Field of Search ..... 101/137, 180, 181, 182, 101/183, 184, 247, 216, DIG. 35; 254/DIG. 7, 133

[56] References Cited

U.S. PATENT DOCUMENTS

| | | | |
|---|---|---|---|
| 3,892,178 | 7/1975 | Staamann | 101/181 |
| 4,137,843 | 2/1979 | Ottenhull | 101/216 |
| 4,381,101 | 4/1983 | Herrin | 254/133 |
| 4,384,522 | 5/1983 | Ehlers et al. | 101/181 |
| 4,887,529 | 12/1989 | Schikawa et al. | 101/181 |
| 4,887,531 | 12/1989 | Ichikawa et al. | 101/216 |
| 4,934,264 | 6/1990 | Gansky et al. | 101/247 |

FOREIGN PATENT DOCUMENTS

| | | | |
|---|---|---|---|
| 123976 | 11/1984 | European Pat. Off. | 101/126 |

OTHER PUBLICATIONS

Brochure entitled "Versatility Has a New Name", Stevens 1000 Multi-Size; Stevens Corporation in Fort Worth, Tex.

Brochure entitled "MP-800 Medium-Run Business Forms Press", by Schaefer and Associates of Dayton, Ohio.

Brochure entitled "Harris Graphics CS-50 Changeable Size Press".

Brochure entitled "Morgan 90 Series" by John Morgan Printing Machinery Limited.

Brochure entitled "TOF Offset Forms Press" by Taiyo Kikai Ltd.

*Primary Examiner*—Edgar S. Burr

*Assistant Examiner*—Ren Yan

*Attorney, Agent, or Firm*—Hovey, Williams, Timmons & Collins

[57] ABSTRACT

An improved, multiple-station convertible web-fed printing press is provided wherein respective press stations include permanent modules with replaceable, differently configured inserts. The station modules each include a pair of eccentrically mounted, insert-engaging rails which are pivoted for accurate placement of a press insert within the module; final insert lockup is provided by an eccentric hook assembly which generates several thousand pounds of locking force, in order to secure the insert against misalignment and subsequent insert shifting. Insert replacement operations are facilitated by means of a mobile cart including insert-supporting rails alignable with the module rails. Temporary interconnection of the cart and module rails is afforded by means of endmost connection hooks and yokes on the cart rails, which mate the module sidewall and the corresponding reduced diameter segments provided in the module rails.

8 Claims, 4 Drawing Sheets

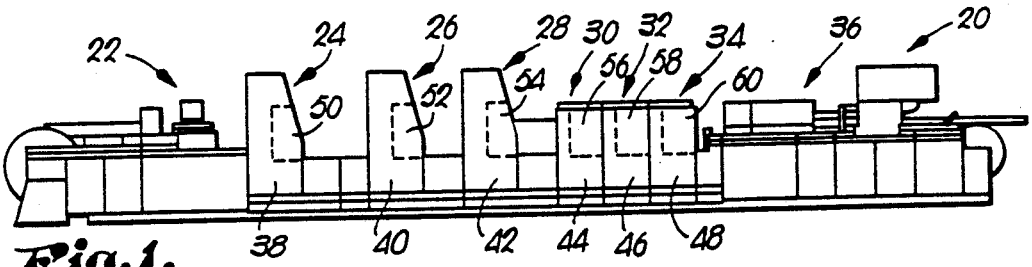
Fig.1.
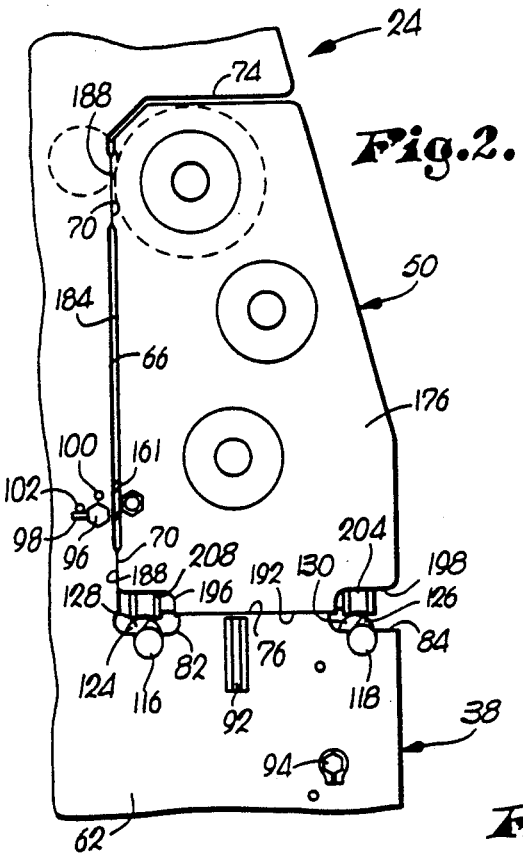
Fig.2.
Fig.5.
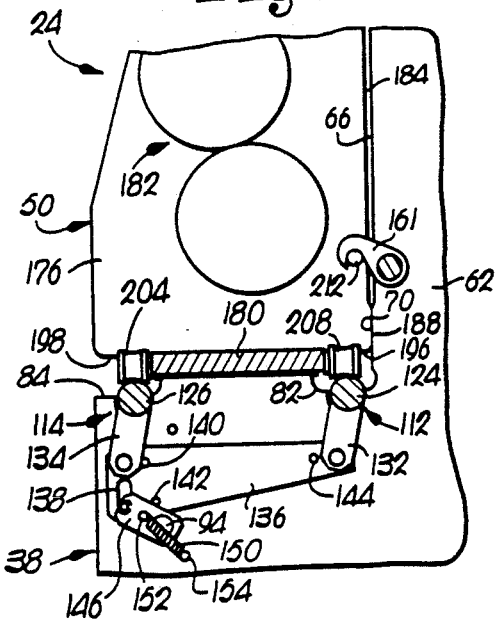
Fig.6.
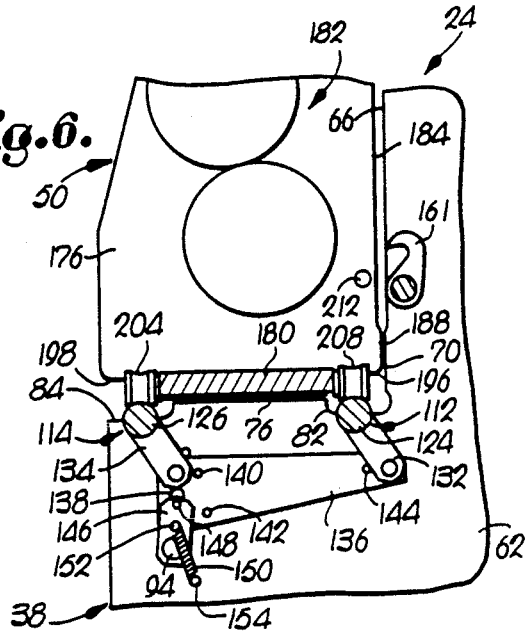
Fig.13.
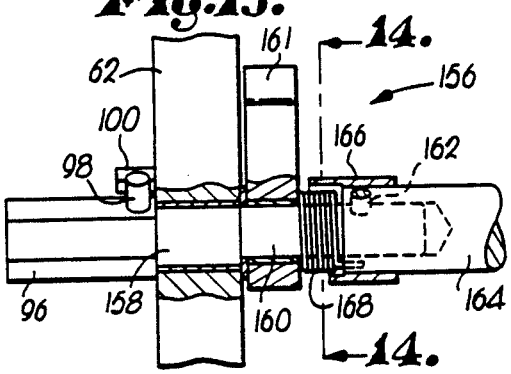

APPARATUS FOR CHANGEOVER OF CYLINDERS IN WEB FED PRINTING PRESS

BACKGROUND OF THE INVENTION

1. Field of the Invention

The present invention is broadly concerned with an improved web-fed printing press characterized by the provision of apparatus for rapid and easy changeover of press components between different press runs. More particularly, it is concerned with such a press, as well as the modular components thereof, which includes in the relevant press stations or towers improved apparatus for placement and removal of changeable press inserts as well as means for securely locking the inserts in place. In this fashion, presses in accordance with the invention can be changed over in a matter of minutes, while retaining the necessary high quality printing characteristics.

2. Description of the Prior Art

Printing press operators are often required to change over a press between press runs. For example, it may be necessary to change the diameter of offset tower cylinders to accommodate different printing requirements; and at the same time, bindery towers may also need to be changed to alter punching and perfing operations. Such changeover requirements are particularly acute for printers engaged in short runs, such as business forms printers who may typically have runs of only several thousand forms. In such cases, the changeover and make ready times may far exceed those of the actual printing runs themselves.

In response to these problems, it has been known in the past to provide convertible presses wherein the respective towers include a replaceable insert. In such presses, operators need only remove a structurally complete insert, typically comprising insert sidewalls supporting functional components such as offset cylinders, in order to change over a given station. In order to provide the most rapid and easy changeover operations, press owners normally stock a plurality of commonly used inserts, these being stored on a rack. A specially designed cart is also employed, which can be wheeled to the storage rack to receive an insert, whereupon it can be moved to the appropriate press station so that the insert can be shifted into operative position in the press.

While convertible presses of this character are known, problems remain in connection with the changeover operations. In particular, insert changeover with many convertible presses requires considerable exertion and effort on the part of the press operators, especially in final alignment and lockup of the inserts. Additionally, some prior convertible presses are deficient in that the insert locking apparatus is simply insufficient to precisely and rigidly align the inserts within the press stations. This can be a serious problem, because seemingly minor misalignment of a press insert within a station can lead to gross printing errors in the resulting run. It will further be appreciated that the conditions of vibrations and mechanical shock incident to press operation can also lead to insert misalignment and motion of the insert relative to the remainder of the station, even if the insert is initially aligned within the press station. Therefore, in order to be truly operable, a press insert must be readily alignable in the press station, and thereafter must be very securely locked in place to maintain alignment and prevent relative motion thereof.

Accordingly, there is a real unsatisfied need in the art for an improved convertible printing press apparatus providing ease of insert removal and placement, while at the same time giving precise, rigid lockup of the inserts during use.

SUMMARY OF THE INVENTION

The present invention overcomes the problems outlined above and provides a greatly improved convertible press assembly which is characterized by extreme ease of insert changeover while giving precise insert alignment and secure insert lockup.

Broadly speaking, a press tower or station in accordance with the invention includes an essentially permanently emplaced module having a pair of laterally spaced apart sidewalls, together with a removeable insert including spaced insert sidewalls adapted to fit within and engage the corresponding module sidewalls. The insert is equipped with lowermost, peripherally concave wheels which extend slightly below the lower margin of the insert sidewalls, so that the insert can be readily moved along complementary rails. The module and insert support functional press components such as cylinder trains so that, in combination, the module and insert form a complete press station such as an offset tower or bindery section.

In order to initially support and align a given insert within a station module, the latter is provided with a pair of spaced apart, elongated rails extending between the module sidewalls. The rails present a pair of upper, insert-engaging surfaces as well as reduced diameter segments inboard of the operator side sidewall for connection purposes. Means is coupled with these rails for selective shifting of the rails when the insert is placed thereon, for final positioning of the insert within the module. In preferred forms, an eccentric rail mounting is provided so as to shift the insertengaging rail surfaces, as well as the supported insert, along a limited arcuate path of travel; the module is correspondingly designed so as to accommodate this travel of the insert and to engage the insert sidewalls at the limit of insert travel. After the insert is aligned and positioned by means of the eccentric apparatus, it is securely and rigidly locked in place by means of a pair of locking hooks pivotally coupled to the module sidewalls. The hooks are specially designed for limited translational shifting thereof during the locking sequence so as to forcefully pull the insert sidewalls into tight engagement with the module sidewalls. Such hook shifting is accomplished by means of mounting of the hooks on an eccentric rotatable shaft through the module sidewalls.

In order to further facilitate insert changeover, a mobile cart is provided which is equipped with spaced insert-supporting rails adapted for alignment with the module rails. To this end, each of the cart rails includes an outboard connection portion presenting an endmost connection hook and yoke. These features are designed for a mating fit with the reduced diameter segments of the module rails and the sidewalls of the module. As a consequence, it is only necessary to wheel the insert cart to a point adjacent the operator side sidewall of the module with the cart rails and module rails being in axial alignment, whereupon the respective connection yokes are lowered into mating engagement with the corresponding reduced diameter segments. This provides a smooth transition between the cart and module rails, so that the insert may be readily shifted therealong.

In addition, the hooking action which occurs as the hooks and yokes are lowered into engagement provides a very secure and safe attachment of the cart to the module. The car cannot move relative to the module as the insert is being shifted, and the chances of personnel injury and/or damage to the machine from an insert dropping off the rails during the shifting operation is eliminated. This safety feature occurs automatically, without any additional mechanisms or separate operator actions being required.

BRIEF DESCRIPTION OF THE DRAWINGS

FIG. 1 is a schematic side view of a convertible printing press in accordance with the invention;

FIG. 2 is a fragmentary, operator side view of a convertible offset printing station of the invention, with a press insert locked within the station module;

FIG. 5 is a fragmentary view in partial vertical section further illustrating the insert in its fully aligned and locked up position within the module;

FIG. 6 is a fragmentary view in partial section similar to that of FIG. 5 but depicting the insert prior to eccentric shifting of the module rails and lockup of the insert;

FIG. 15 is a sectional view similar to that of FIG. 14, but depicting the hook in its locking position in engagement with a locking stud secured to an insert sidewall.

DESCRIPTION OF THE PREFERRED EMBODIMENTS

Figure 3:
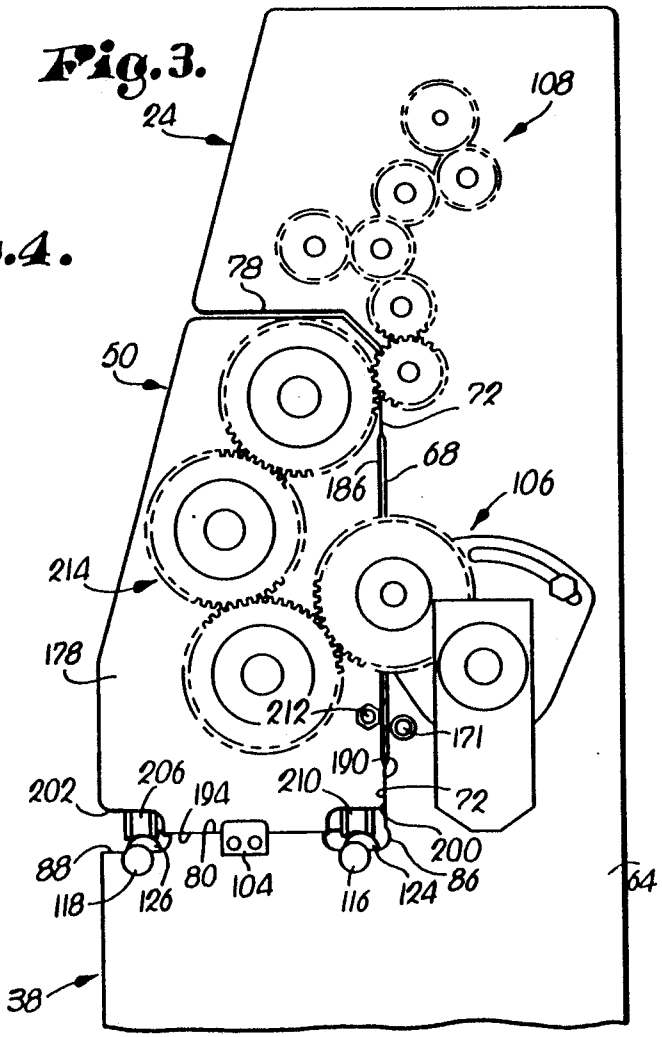
FIG. 3 is a fragmentary, drive side view of the station depicted in FIG. 2.

Turning now to the drawings, and particularly FIG. 1, a convertible press 20 is illustrated. The press 20 is an in-line, web-fed press having, in order, a roll stand assembly 22, a plurality of offset stations 24–28, a number of bindery stations 30–34 (e.g., numbering, perfing, punching), and final sheeter folder and rewind apparatus 36. It will of course be appreciated that the configuration of press 20 can be changed to include more or less offset and bindery stations and other stations such as numbering, as the dictates of a particular printer require In any event, the stations 24–34 each include an essentially permanently emplaced module 38–48, as well as corresponding replaceable inserts 50–60. In each case, the respective module/insert sets cooperatively present a complete, functional press station, with the inserts being replaceable as described below. In the following discussion, particular reference will be had to station 24 and its corresponding module 38 and insert 50; it will be appreciated however, that such discussion is equally applicable to the remaining stations of the press 20.

Figure 10:
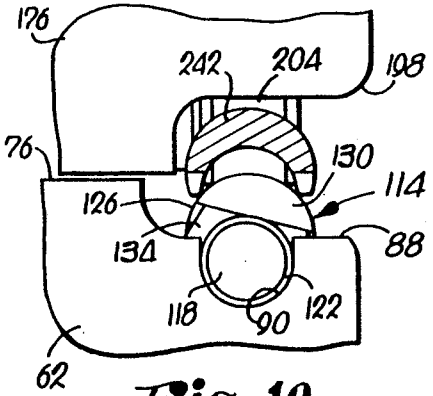
FIG. 10 is a fragmentary view in partial vertical section illustrating the connection hook and yoke of one cart rail positioned above a corresponding module rail recess, prior to lowering of the hook and yoke into the recess for connection purposes.
Figure 11:
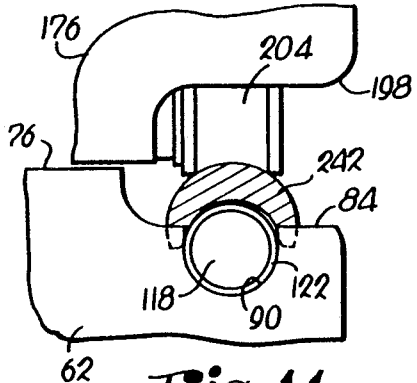
FIG. 11 is a view similar to that of FIG. 10, but depicting the connection hook and yoke in mating engagement with the module rail recess and module sidewall.
Figure 12:
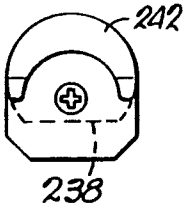
FIG. 12 is an end elevational view of a cart rail, illustrating the downwardly opening connection hook and yoke thereof.

In more detail, exemplary module 38 includes a pair of upright, laterally spaced apart sidewalls, namely operator side sidewall 62 and opposed gear or drive side sidewall 64. Each of these sidewalls is recessed and presents an upstanding recess wall 66, 68 having a pair of vertically spaced apart, outwardly extending pad sections 70, 72, as well as opposed upper and lower recess walls 74, 76 and 78, 80. The lower, horizontally extending recess walls 76, 80 are provided with downwardly extending, endmost relieved areas 82, 84 (sidewall 62) and 86, 88 (sidewall 64). Each of the areas 82–88 is also provided with a semicircular central recess 90 (see FIGS. 10–11) adapted to receive a bushing.

The outboard face of sidewall 62 includes a positioning tongue 92 as well as hex head operating shafts 94, 96. As best seen in FIG. 2, the shaft 96 is equipped with a pin 98, and the sidewall 62 includes a pair of spaced, projecting limit stop pins 100, 102 adjacent the shaft 96. The outboard face of drive side sidewall 64 (FIGS. 3–4) includes an upstanding stop 104 between the relieved areas 86, 88, as well as a pivotally shiftable swing gear assembly 106 and other appropriate driving gears broadly referred to by the numeral 108 for rotation of the station press components situated between the sidewalls 62, 64. In the case of offset station 24, the functional components would normally include an inking train made up of the usual ink tray and appropriate form, dancer and ink-applying rolls (not shown).

The module 38 also includes a pair of laterally extending, spaced apart insert-engaging rails 112, 114 which are in spanning relationship to walls 62, 64 and parallel with each other. Each rail 112, 114 includes oppositely extending, reduced diameter stub connectors 116, 118 which are received within corresponding bushings 120, 122 secured within the central recesses 90 of the relieved areas 82–88. Each of the rails further includes an eccentric central portion 124 (rail 112), 126 (rail 114) and a reduced diameter segment 128, 130 just inboard of the inner surface of operator side sidewall 62. The eccentric central portions 124, 126 of the rails 112, 114 present an uppermost, insert-engaging surface for each rail.

In operation, the rails 112, 114 rotate within their mounting bushings 120, 122. To this end, each rail is provided with a downwardly extending link 132, 134 which is rigidly secured to the corresponding rail just inboard of the associated reduced diameter segments 128, 130. A spanning connector plate 136 is situated inboard of sidewall 62 and is pivotally connected to the lowermost ends of the spaced links 132, 134. The plate 136 is provided with a slot 138, and also has three nylon buttons 140, 142, 144. A crank 146, secured to operating shaft 94, is provided adjacent plate 136 and includes a cam follower roller 148 received within slot 138 of plate 136. Finally, a coil spring 150 is attached between pins 152, 154, respectively secured to crank 146 and operator side sidewall 62.

Figure 13:
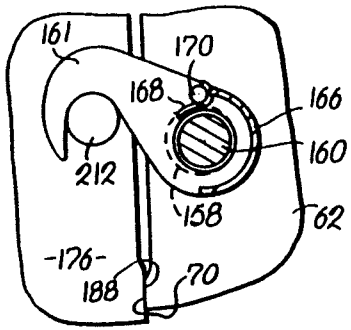
FIG. 13 is a fragmentary view in partial section and with parts broken away for clarity of the preferred locking hook assembly forming a part of a press module of the invention.
Figure 14:
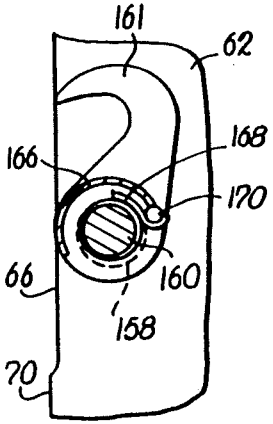
FIG. 14 is a vertical sectional view taken along line 14—14 of FIG. 13 and illustrating the locking hook in its recessed, insert-cleaning position.

The module 38 is also equipped with a specialized hook mechanism for locking insert 50 in place. In particular, the hook mechanism 156 includes a stepped shaft 158 integral with operating shaft 96 which includes an inwardly extending hook-supporting shaft portion 160 eccentrically oriented relative to operating shaft 96 (see FIG. 13). A locking hook 161 is rotatable about the shaft portion 160 just inboard of sidewall 62. The shaft portion 160 also includes a transverse pin 162 which serves to secure a spanning shaft 164 and collar 166 to the portion 160. A torsion spring 168 is disposed about the portion 160 with the ends thereof being coupled to spanning shift 164 and to a stud 170 integral with hook 161 (see FIGS. 14–15). The end of spanning shaft 164 adjacent drive side sidewall 64 receives an eccentric stepped shaft 171 similar to shaft 158 which supports a drive side locking hook 172.

Insert 50 is a self-contained unit including an upright operator side sidewall 176 and a spaced opposed drive side sidewall 178. The sidewalls are interconnected by means of, inter alia, a bottom connector plate 180 and define therebetween a region for receipt of functional press components such as an offset printing cylinder train 182. The sidewalls 176 include upright side margins 184, 186 equipped with contact pads 188, 190, as well as lower module contacting margins 192, 194. As will be observed from a study of the drawings, the sidewalls 176, 178 are oriented for alignment with the corresponding module sidewalls 62, 64, with the pad sections 70, 72 of the module sidewalls being located for engagement with the contact pads 188, 190 of the insert sidewalls.

It will further be observed that the module sidewalls 176, 178 are provided with a pair of spaced apart, upwardly extending recesses 196, 198 and 200, 202 adjacent the fore and aft end regions thereof. The recesses 196–202 generally align with the relieved areas 82–88 provided in module sidewalls 62, 64.

The insert 50 has a total of four wheels 204–210 which are arranged in aligned pairs. The first pair, consisting of wheels 204 and 208, is located just inboard of operator side sidewall 176, whereas the second pair, consisting of wheels 206 and 210, is similarly located just inboard of drive side sidewall 178. All of the wheels 204–210 are rotationally coupled to bottom plate 180 and are mounted for rotation about fore and aft extending axes which are generally parallel with the insert sidewalls. Furthermore, each of the wheels includes a continuous, concave peripheral working surface adapted to mate with the module rails 112, 114; and as best seen in FIGS. 2–3, the wheels extend slightly below the lower margins 192, 194 of the insert sidewalls 176, 178.

Figure 4:
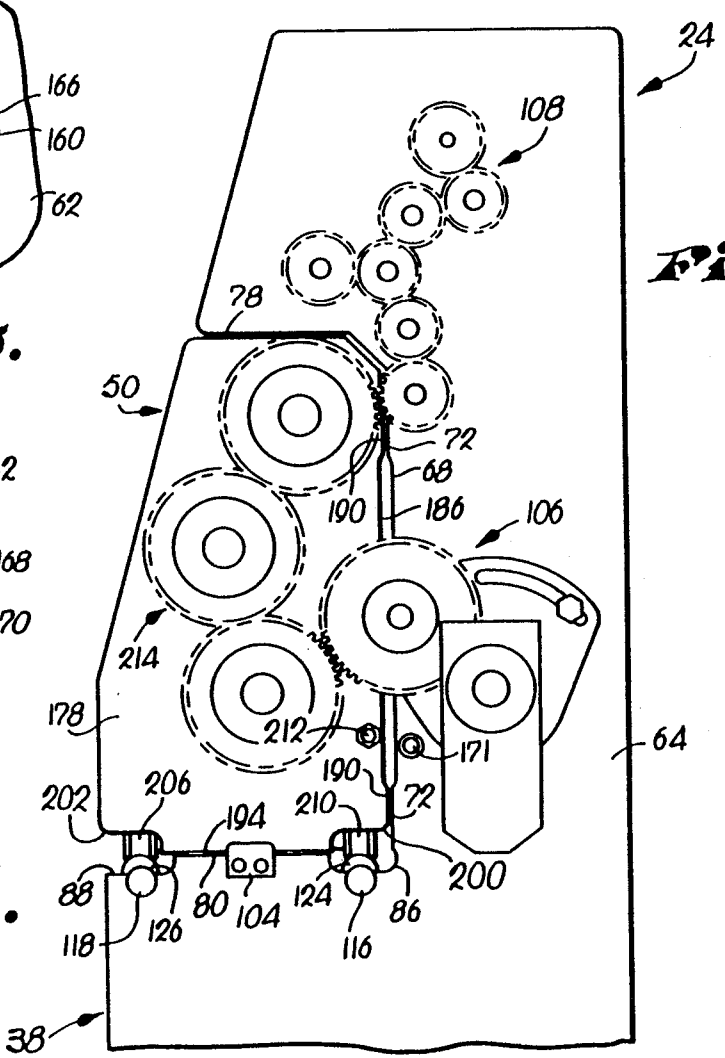
FIG. 4 is a view similar to that of FIG. 3, but illustrating the insert prior to lockup and operative connection thereof.

Each sidewall 176, 178 is equipped with an inwardly extending, hook-receiving, eccentric locking stud 212 which is located for locking interengagement with an associated hook 161, 172. Finally, as shown in FIGS. 3 and 4, the drive side sidewall 178 is equipped with an appropriate gear train 214 operatively coupled to the functional press components between the sidewalls and adapted to mesh with the swing gear of assembly 106.

In order to facilitate insertion and removal of insert 50, a mobile cart 216 is provided. The cart 216 includes a wheeled lower frame 218, upright steering handle 220, and as a generally horizontal table 222. The table 222 is supported by means of a scissor linkage 224 coupled with frame 218, so as to permit up and down movement of table 222 through manual actuation (via foot peddle 225) of piston and cylinder assembly 226.

Figures 7, 16:
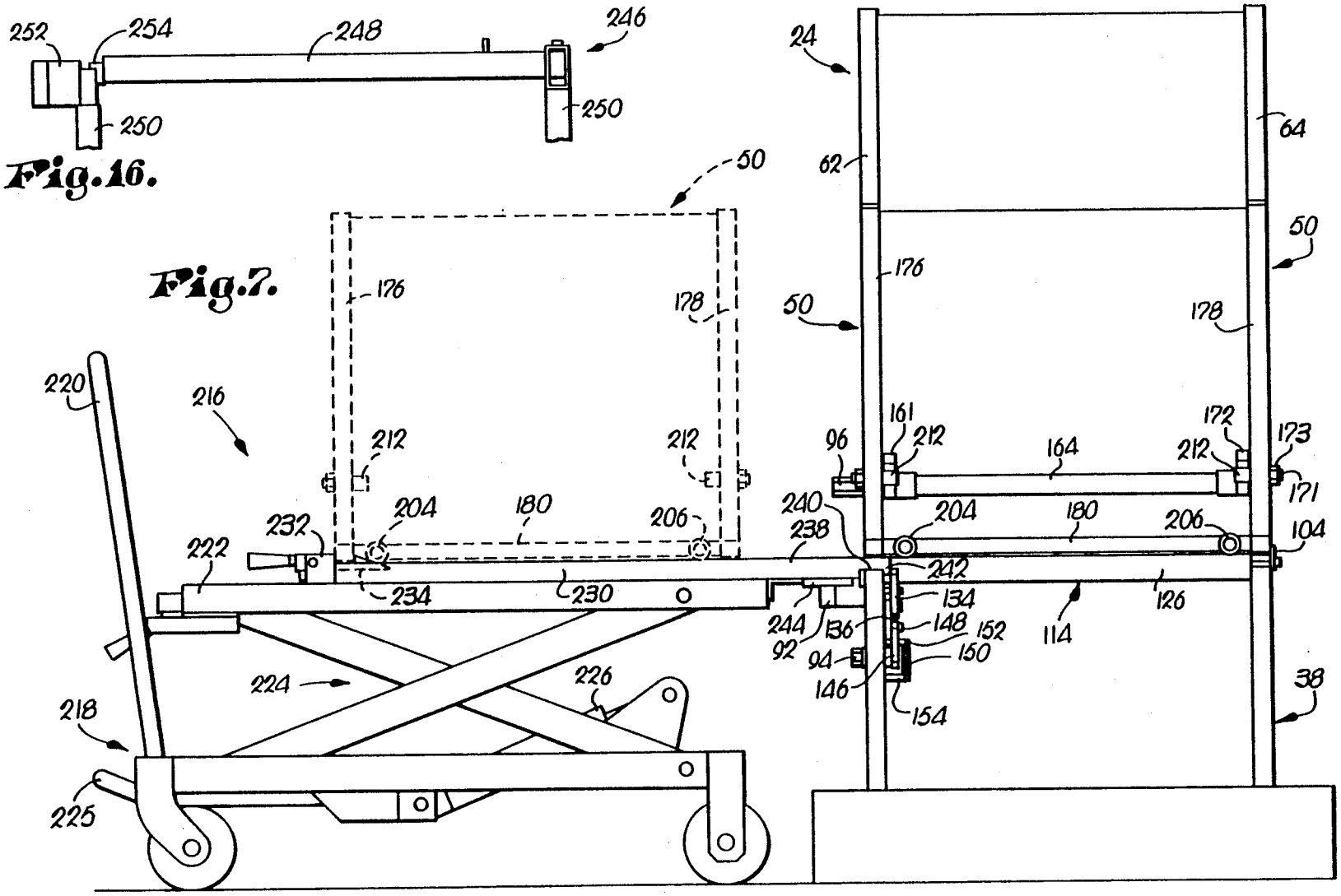
FIG. 7 is an end view illustrating the mobile insert-supporting cart of the invention aligned and coupled with a press station during insert removal/placement operations.
FIG. 16 is a fragmentary side view illustrating a storage rack for press inserts.
Figure 8:
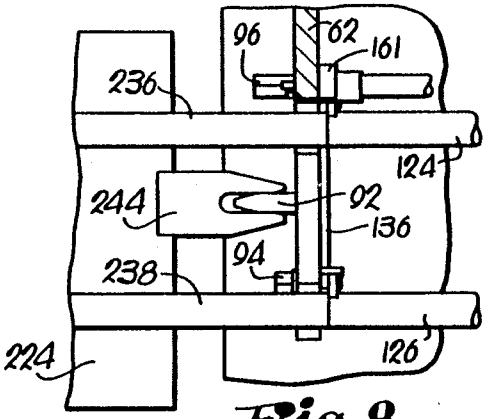
FIG. 8 is a fragmentary top view illustrating the interconnection between the cart and module rails.
Figure 9:
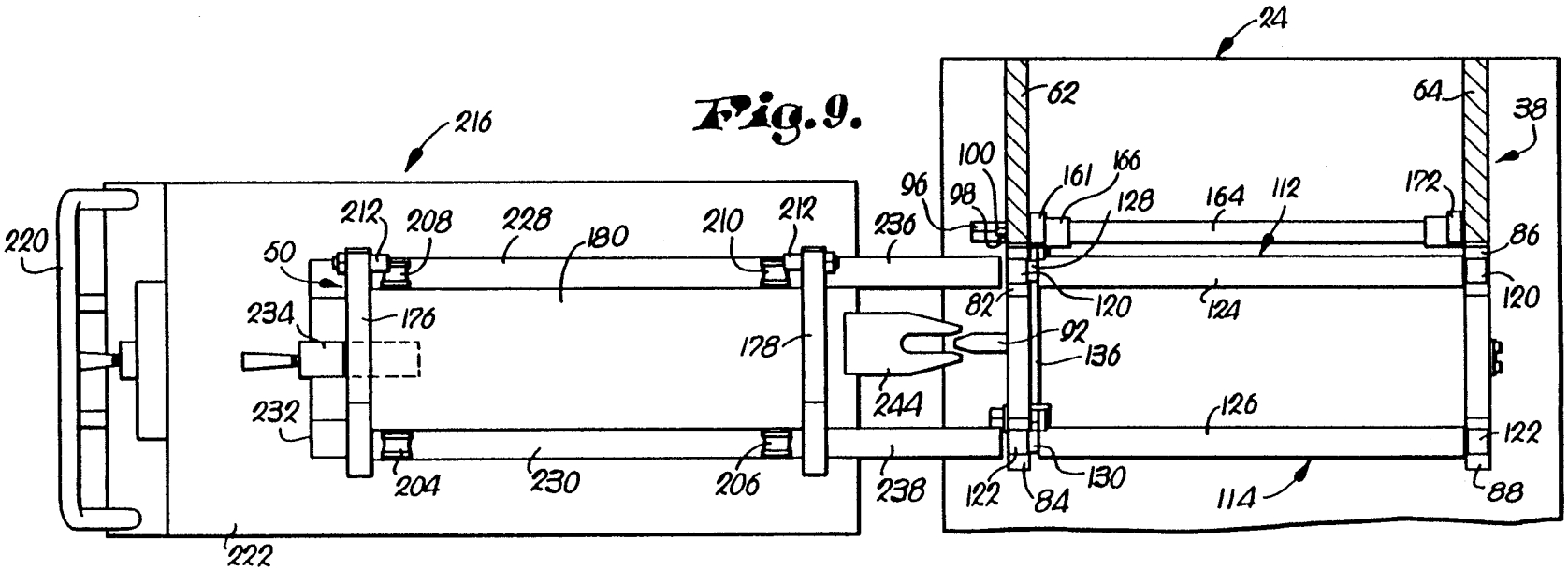
FIG. 9 is a plan view depicting the insert cart in general alignment with a press station module, prior to connection of the cart and module.

The table 222 supports a pair of elongated, spaced apart, arcuate in cross-section insert-supporting rails 228, 230. A stop block 232 together with a hand operated spring latch 234 are provided adjacent the left hand ends of the rails 228, 230 as seen in FIGS. 7 and 9. Each of the rails 228, 230 includes an outwardly extending portion 236, 238 configured to present a recessed zone 240 and an endmost, downwardly opening tapered connection hook and yoke 242. The recess zones 240 are of sufficient length to accommodate the thickness of module sidewall 62, whereas the hooks and yokes 242 are adapted for a tight, mating fit within the reduced diameter segments 128, 130 of the module rails 112, 114. Finally, as best seen in FIGS. 8 and 9, a connection fork 244, complemental with tongue 92, extends forwardly from table 224 between the extension portions 236, 238.

In order to provide readily assessible storage for insert 50 when not in use, a storage rack 246 (FIG. 16) forms a part of the overall press apparatus. The rack 246 is stationary, and includes a plurality of mated pairs of insert-supporting rails 248 extending between upright supports 250. The receiving end of rack 246 is equipped with a tongue 252 similar to tongue 292 provided on module 38. In addition, the ends of the rails 248 are as at 254 for receiving the connection yokes 242 of the cart rail extensions 236, 238.

OPERATION

During the printing operations of station 24, it will of course be appreciated that insert 50 is situated within module 38, in the position depicted in FIGS. 2, 3 and 5 where the hooks 61, 172 are in engagement with studs 212 and the insert sidewalls 176, 178 are in firm contact with the module sidewalls 62, 64. Furthermore, in such orientation the swing gear of assembly 106 is in mesh with gear train 214, and the latter is further in mesh with inker driving gears 108. In this mode, power supplied via a common press drive (not shown) serves to properly rotate the functional press components within the module and insert.

If it is desired to remove insert 50 and replace it with a different insert, the following occurs. First, power to the station is shut down, and assembly 106 is manipulated so as to move the swing gear out of engagement with gear train 214. At this point cart 216 is wheeled into the position adjacent the operator side of station 24 illustrated in FIG. 9, where fork 244 is proximal to tongue 92, and the cart rails 228, 230 are in general alignment with module rails 124, 126. The table 222 of cart 216 is then slightly elevated, and the cart moved rightwardly as viewed in FIG. 9 until tongue 92 is inserted within fork 244 and the cart rail extensions 236, 238 pass through the spaced openings cooperatively defined by relieved area 82 and recess 196, and relieved area 84 and recess area 198. The table 222 is then lowered so that the connection forks 242 come in to tight mating engagement with the rail recesses 128, 130 such being accommodated by virtue of cart rail recesses 240. In this configuration, it will be observed (see FIG. 7) that the cart and module rails form essentially continuous rail bodies for the movement of insert 50 therealong; and the mobile cart 216 is securely and safely attached to operator-side sidewall 62 by means of connection hooks and yokes being hooked over the upper surfaces of relieved areas 82 and 84.

In the next step, operating shaft 96 is rotated approximately 270° until pin 98 engages limit, stop 100. This serves to retract the hooks 161, 172 from the associated studs 212 until the hooks assume their insert-clearing position depicted in FIG. 14 where one end of collar 166 abuts stud 170.

Next, operating shaft 94 is rotated so as to move crank 146, and hence plate 136 and links 134, from the position illustrated in FIG. 5 to that of FIG. 6. In the FIG. 6 position, it will be observed that the central sections 124, 126 of the module rails engage the concave working surfaces of the wheels 204–210 so as to slightly lift the insert off of the lower recess margins 76, 80 forming part of module sidewalls 62, 64. The insert 50 can then be readily rolled along the length of the interconnected module and cart rails until the insert is fully supported on cart 16. In practice, the insert 50 is moved until it engages stop block 232, and spring latch 234 is engaged to hold the insert in place on the cart.

In order to detach the cart 216, now bearing the insert 50, from module 38, it is only necessary to first slightly elevate table 222 so as to retract the connection yokes 242 from the recesses 128, 130, whereupon the cart may be pulled away from the module.

The insert 50 may be stored on rack 246 by first aligning the cart rails with an empty pair of rack rails 248. The cart 216 is connected to rack 246 in exactly the same manner as described above, i.e., the table 222 is slightly elevated, the connection yokes 242 are located above rail recesses 254, and the cart table is then lowered. The insert 50 can then be rolled from the cart 216 to rack 246.

The cart 216 is then used to retrieve another insert from rack 246 in the manner described, so that the new insert may be wheeled to module 38 for insertion therein. Again, this procedure is precisely as described above, with initial alignment and interconnection of the cart and module rails, followed by the rolling of the new insert into the confines of module 38 until the drive side insert wall abuts stop 104 The operating shaft 94 is then rotated so as to move the insert-engaging surfaces of the module rails along a limited arcuate path of travel, with the result that the insert is moved rightwardly as viewed in FIG. 6 until contact pads 188, 190 engaged the pad section 70, 72 and the lower insert wall margins 192,194 coontact the adjacent module wall margin 76, 80. In the orientation, the rails 112, 114 are out of contact with the wheels 204–210.

The final lockup step involves clockwise rotation of operating shaft 96 until pin 98 contacts stop 102. During this rotation, the hook 161, 172 first move into contact and general hooking relationship with the studs 212. Then, the eccentric mounting arrangement of the hooks comes into play. Specifically, such eccentric mounting serves to translate the hooks rightwardly to a limited extent as viewed in FIG. 15 so as to tightly pull the insert into place within the module. In practice, it has been found that such an eccentric hook arrangement generates something on the order of 6,000 pounds of locking force in the lateral direction, and approximately 1,000 pounds of force in the vertical direction. The actual amount of force can be preset at a desired magnitude by rotation of the eccentric studs 212. In this fashion, the insert is rigidly secured within the module so as to preclude any printing errors which may otherwise arise by virtue of insert misalignment or relative motion between the insert and module sidewalls due, e.g., to machine vibration. Another advantage of the lockup assembly of the invention is that it gives a visual indication of full lockup. That is, if the hooks 161, 172 fail to come in to full locking engagement with the studs 212, it is impossible to rotate operating shaft 96 to a point where pin 98 contacts limit stop 102, since the rotation will have been stopped by contact between collar 166 and stud 170. The operator therefore knows that the insert is not correctly aligned and/or secured in place.

After lockup is complete, it is only necessary to manipulate swing gear assembly 106 so as to place all of the driving gears of the station 24 in mesh. This completes the reassembly of station 24 and the latter is then in condition for make ready and printing operations, assuming that all necessary cleanup and other adjustments of the module 38 have been made.

While the above discussion has centered upon a printing station 24, those skilled in the art will appreciate that the. invention is not so limited. In fact, presses in accordance with the invention are made with replaceable bindery and numbering inserts, as well as those for offset stations Of course, the placement and removal operations with such bindery inserts are essentially identical with those described above.

I claim:

1. A module for a printing press adapted to receive a replaceable insert and to form therewith a complete, functional station for the press, said module comprising:

a pair of laterally spaced apart module sidewalls each presenting a surface for supporting a corresponding wall of said insert, a pair of spaced apart rails extending laterally between said sidewalls and presenting upper, insert-engaging surfaces; and means operatively coupling said rails to said sidewalls, including structure for selective shifting said insert-engaging rail surfaces along a limited arcuate path of travel when said insert is placed on said rails, for positioning of said insert within said module, said rail surface-shifting structure comprising a pair of aligned bushing members respectively supporting the ends of each corresponding rail, said bushing members defining a pair of axes, and motive means operatively connected to said rails for selective eccentric rotational movement of said rails about the axes defined by said bushing members.

2. The module of claim 1, said motive means comprising a link operatively coupled to each rail, a connector plate, means pivotally coupling each of said links too said plate, and means for selectively moving said connector plate for corresponding shifting movement of said links and shifting of said rail surfaces.

3. A module for a printing press adapted to receive a replaceable insert and to form therewith a complete , functional station for the press, said module comprising:

a pair of laterally spaced apart module sidewalls each presenting a surface for supporting a corresponding wall of said insert, a pair of spaced apart rails extending laterally between said sidewalls and presenting upper, insert-engaging surfaces; and means operatively coupling said rails to said sidewalls, including structure for selective shifting said insert-engaging rail surfaces along a limited arcuate path of travel when said insert is placed on said rails, for positioning of said insert within said module, said rail-surface-shifting structure including means for movement of said rail surfaces out of supporting engagement with said insert upon shifting thereof for positioning of the insert within the module.

4. A module for a printing press adapted to receive a replaceable insert and to form therewith a complete, functional station for the press, said module comprising:

a pair of laterally spaced apart sidewalls;

a pair of spaced apart rails extending laterally between said sidewalls and presenting upper, insert-engaging surfaces; and means operatively coupled with said rails for selective shifting thereof when said insert is placed thereon, for positioning of said insert within the module, said rail-shifting mans comprising structure for limiting arcuate travel of said insert-engaging rail surface, said structure comprising means eccentrically mounting each of said rails to said sidewalls, and motive means operatively coupled with said rails for selective eccentric shifting thereof.

5. In combination:

a printing press module adapted to receive a replaceable insert and to form therewith a complete, functional station for a printing press, said module comprising laterally spaced apart operator side and drive side module sidewalls, and a pair of spaced apart module rails extending laterally between said sidewalls and presenting upper, insert-engaging surfaces, each of said module rails including structure defining a reduced diameter segment inboard of said operator side sidewall; and a mobile cart adapted to support a replaceable insert and including a pair of spaced apart insert-supporting cart rails, each of said cart rails including an elongated, forwardly extending connection portion having a connection hook and yoke, said cart and module being cooperatively configured and arranged for end-to-end axial alignment of said cart rails and said module rails when said cart is positioned adjacent said operator side module sidewall, the connection hook and yoke of each of said connection portions being oriented for mating within a reduced diameter segment of a corresponding one of said module rails for presenting a smooth transition between said cart rails and module rails to facilitate shifting of an insert between said cart and said module along the aligned rails.

6. The combination of claim 5, said cart including means for selective up and down shifting thereof whereby said connection hooks and yokes may be positioned above the corresponding module rail reduced diameter segments and thereafter lowered into mating relationship therewith.

7. The combination of claim 5, including a laterally outwardly extending connection tongue secured to said operator side module sidewall, and a connection fork secured to said cart and adapted to receive said tongue.

8. In a functional press station comprising a module and a replaceable insert which cooperatively define said station, said module and said insert each including laterally spaced apart, cooperating, mutually engaging sidewalls, the improvement of apparatus for securing said insert to clearing said module which comprises:

a pair of hook members:

means mounting each of said hook members to a corresponding module sidewall for selective pivotal movement of the hooks between a retracted, insert-clearing position and a locking position, said hook mounting means further including structure for limited translational shifting of the hook relative too its corresponding module sidewall during said pivotal movement thereof in a direction for pulling said module and insert sidewalls into tight interengagement;

stud means coupled to said insert sidewalls and located for locking engagement with said hooks when the hooks are in the locking position thereof; and an operating shaft portion pivotal about a first axis, and a hook-supporting shaft portion coupled to said operating shaft and eccentrically mounted relative thereto for pivoting of the hook-supporting shaft about a second axis spaced from said first axis.

* * * * *